US007104016B2

(12) United States Patent
Kerr

(10) Patent No.: US 7,104,016 B2
(45) Date of Patent: Sep. 12, 2006

(54) PREFABRICATED DOOR FRAME AND DOOR

(76) Inventor: Ian Kerr, 850 Listowel Line, Ennismore, Ontario (CA) K0L 1T0

( * ) Notice: Subject to any disclaimer, the term of this patent is extended or adjusted under 35 U.S.C. 154(b) by 585 days.

(21) Appl. No.: 10/617,801

(22) Filed: Jul. 14, 2003

(65) Prior Publication Data

US 2004/0016182 A1 Jan. 29, 2004

(30) Foreign Application Priority Data

Jul. 24, 2002 (CA) ..... 2394849

(51) Int. Cl.
*E06B 1/04* (2006.01)

(52) U.S. Cl. ..... 52/210; 52/206; 52/204.1; 52/656.2

(58) Field of Classification Search ..... 52/210, 52/206, 204.1, 205, 656.2, 656.4; 49/199, 49/206, 504

See application file for complete search history.

(56) References Cited

U.S. PATENT DOCUMENTS

| | | | | |
|---|---|---|---|---|
| 2,711,564 | A | 6/1955 | Jackson | |
| 2,781,559 | A | 2/1957 | Savoie | |
| 2,886,860 | A | 5/1959 | Zem | |
| 3,239,978 | A | 3/1966 | Parker | |
| 3,808,759 | A | 5/1974 | Carmichael | |
| 4,281,480 | A | 8/1981 | Wendt | |
| 4,509,294 | A | 4/1985 | Boilard | |
| 5,901,510 | A | 5/1999 | Ellingson | |
| 5,901,511 | A * | 5/1999 | Yoshida | 52/212 |

FOREIGN PATENT DOCUMENTS

| | | |
|---|---|---|
| CA | 604140 | 8/1960 |
| CA | 995981 | 8/1976 |
| CA | 2035521 | 2/1991 |
| CA | 2148142 | 6/1995 |
| CA | 2192420 | 12/1996 |
| CA | 2214734 | 9/1997 |
| CA | 2282816 | 9/1999 |

* cited by examiner

*Primary Examiner*—Brian E. Glessner
*Assistant Examiner*—Basil Katcheves
(74) *Attorney, Agent, or Firm*—Shoemaker and Mattare

(57) ABSTRACT

A doorframe includes a header having a header jamb and a pair of header casings. The header has first and second ends. The doorframe further includes a pair of legs, each having a leg jamb and a pair of leg casings. Each leg jamb has means for connection with the respective end of the header, at least two recessed hinge placements on a first side of the leg jamb and at least two recessed hinge placements on a second side of the first leg jamb. Each of the recessed hinge placements are suitable for receiving a first side of a hinge. A pair of precut striker plate placements and striker holes are provided on one of the leg jambs for receiving a striker of a door when the doorframe is assembled and a door is attached to the recessed hinge placements on the other leg jamb.

18 Claims, 5 Drawing Sheets

PREFABRICATED DOOR FRAME AND DOOR

FIELD OF THE INVENTION

This invention relates in particular to prefabricated wood doorframes including two vertical legs and a header, and doors.

BACKGROUND OF THE INVENTION

Construction or renovation projects often require the framing of doors. Doorframes are conventionally constructed on site in a "roughed-in" door opening. There are several disadvantages to on-site construction of a doorframe. Proper construction of a doorframe requires precision. Thus, for the average person, hanging doors is very difficult and very frustrating work due to the level of precision required for proper installation of a working door in a doorframe. Therefore, this work demands the services of a person skilled in the trade. Even still, this work can be slow and costly.

Prefabricated doorframes have been used in an attempt to mitigate these problems. Factory assembled prefabricated doorframes have proven to be problematic, however, due to their inherent size and fragility. Furthermore, the prefabricated doorframe still requires fitting in the door opening, demanding a high level of skill to complete this task. Even still, door trim must be installed after the installation of the prefabricated doorframe. Thus, the work is still difficult and frustrating for an unskilled person attempting to install the doorframe.

Other attempts at prefabricated doorframes include partially assembled frames. These partially assembled frames still require skilled labor and the installation work can be slow.

All of these prefabricated systems can be problematic due to bending, cracking or warping of the wood. These systems generally include a doorstop attached to the frame, in the finished state. Thus, if the doorframe bends or warps prior to or during installation, or if the doorframe is not exactly level, the door might not rest against the doorstop when the door is in the closed position. For example, the bottom of the door may hit the doorstop while the top of the door is still spaced from the doorstop, or vice versa. This can also cause the door to bind in the frame.

Canadian Patent No. 2,035521 to Critch teaches a prefabricated floating doorframe that includes slots in the header of the frame, into which the leg jambs are inserted. The leg jambs are cut at the top in a reciprocating rabbit joint, for fitting into a respective slot. While this-system mitigates some of the problems of the prior art, it suffers other disadvantages. For example, the precut jambs of these doorframes are generally constructed of a medium density fiberboard (MDF) that is about ½ inch thick. Also, the casing cut and the slot cut in the header jamb are at the same longitudinal spacing along the header. The slot in the header jamb is a weak point in the doorframe that is susceptible to breaking. Upon installation, the installer installs the header first and then the legs. If the legs are not inserted properly, or the wall studs are warped, the installer risks breaking the angled cut (forty-five degree cut) of the header casing. Also, the door is placed into the frame when the frame is not yet fastened The header is then used to pull or push the top of the door and frame to a level position. This can result in breaking of the header jamb at the slot.

All of these prefabricated doorframe systems suffer further disadvantages in that the hardware or building supply stores that stock these doorframes must keep two sets of every doorframe and door. The two sets are required for providing both a left-handed opening door and a right-handed opening door.

Each prefabricated doorframe includes a pair of leg jambs. One of the pairs of leg jambs includes a pair of recessed hinge placements on one side of the jamb, where the door hinges are attached to the doorframe. The opposing leg jamb includes a precut striker plate attachment and striker hole on a complementary side of the leg jamb, for receiving the striker plate. A doorframe for a left-handed opening door has hinge placements on the opposite side of the leg jamb as a doorframe for a right-handed opening door. Similarly, a doorframe for a left-handed opening door has the striker plate attachment and striker hole on the opposite side of the leg jamb as a doorframe for a left-handed opening door. Therefore, two sets of doorframes must be made available for each doorframe size.

Also, each door for hinged attachment in the doorframe includes precut hinge placements on a rear edge of the door, cut for example, by a router. The rear edge including the precut hinge placements, and the front edge are beveled to ensure that the door does not bind in the doorframe. Thus, a left-banded opening door has opposite bevels compared to a right-handed opening door. Therefore each building supply store must also stock two sets of doors for each door size, one for right-handed and one for left-handed opening doors.

Stocking two different sets of doorframes and doors for every size of door requires building supply stores to keep larger inventories and requires the purchaser of the doorframe and door to know in advance which doorframe and door are desired or required. Furthermore, the purchaser must match the correct door with the correct doorframe to ensure that the correct door is purchased for the desired doorframe. Further still, this requires accurate labeling by the manufacturer.

Accordingly, it is an object of an aspect of the present invention to provide a prefabricated doorframe system which obviates or mitigates at least some of the disadvantages of the prior art.

SUMMARY OF THE INVENTION

In accordance with one aspect of the present invention, there is provided a doorframe system comprising a header having a header jamb and a pair of header casings. The header has first and second ends. The doorframe further comprises a first leg having a first leg jamb and a pair of first leg casings. The first leg jamb has means for connection with the first end of the header, at least two recessed hinge placements on a first side of the first leg jamb and at least two recessed hinge placements on a second side of the first leg jamb. Each of the recessed hinge placements are suitable for receiving a first side of a hinge. The doorframe further comprises a second leg having a second leg jamb and a pair of second leg casings. The second leg jamb has means for connection with the second end of the header. A first precut striker plate placement and striker hole on a first side of the second leg jamb is provided for receiving a striker of a door when the doorframe is assembled and a door is attached to the at least two recessed hinge placements on the first side of the first leg jamb. A second precut striker plate placement and striker hole on a second side of the second leg jamb is provided for receiving a striker of a door when the doorframe is assembled and a door is attached to the at least two recessed hinge placements on the second side of the first leg jamb.

In accordance with another aspect of the present invention, there is provided a door and doorframe system having a door with first and second sides and front and rear edges. The door further has at least two recessed hinge placements in the rear edge and extending the width thereof. Each of the at least two recessed hinge placements are for receiving a second side of a hinge. A header having a header jamb and a pair of header casings is provided. The header has first and second ends and a pair of laterally spaced holes proximal each of the first and second ends. A first leg having a first leg jamb and a pair of first leg casings is provided. The first leg jamb has a pair of dowels extending from an end thereof for being received in the pair of holes proximal the first end of the header when the system is assembled. The first leg jamb further has at least two recessed hinge placements on a first side of the first leg jamb and at least two recessed hinge placements on a second side of the first leg jamb. Each of the recessed hinge placements are suitable for receiving a first side of a hinge. A second leg having a second leg jamb and a pair of second leg casings is provided. The jamb of the second leg has a pair of dowels extending from an end thereof for being received in the pair of holes proximal the second end of the header when the system is assembled. The second leg jamb has a first precut striker plate placement and striker hole on a first side of the jamb for receiving a striker of the door when the doorframe is assembled and the door is attached to the at least two recessed hinge placements on the first side of the first leg jamb. A second precut striker plate placement and striker hole is provided on a second side of the second leg jamb for receiving a striker of the door when the doorframe is assembled and the door is attached to the at least two recessed hinge placements on the second side of the first leg jamb. The door is attachable by hinges to either of the at least two recessed hinge placements on the first side of the first leg jamb and the at least two recessed hinge placements on the second side of the first leg jamb.

In accordance with yet another aspect of the present invention, there is provided a method of installing a doorframe system into a dry-walled, roughed-in opening. The doorframe system has a header having a header jamb and a pair of header casings. The header has first and second ends. The doorframe further comprises a first leg having a first leg jamb and a pair of first leg casings. The first leg jamb has means for connection with the first end of the header, at least two recessed hinge placements on a first side of the first leg jamb and at least two recessed hinge placements on a second side of the first leg jamb. Each of the recessed hinge placements are suitable for receiving a first side of a hinge. The doorframe further comprises a second leg having a second leg jamb and a pair of second leg casings. The second leg jamb has means for connection with the second end of the header. A first precut striker plate placement and striker hole on a first side of the second leg jamb is provided for receiving a striker of a door when the doorframe is assembled and a door is attached to the at least two recessed hinge placements on the first side of the first leg jamb. A second precut striker plate placement and striker hole on a second side of the second leg jamb is provided for receiving a striker of a door when the doorframe is assembled and a door,is attached to the at least two recessed hinge placements on the second side of the first leg jamb. The method includes: placing the header and first leg in the roughed-in doorway and inserting the dowels of the first door leg into the holes of the first end of the header; placing the second leg in the roughed-in doorway and inserting the dowels of the second door leg into the holes of the second end of the header; hanging a door using hinges on one of the at least two recessed hinge placements on a first side of the first leg jamb and at least two recessed hinge placements on a second side of the first leg jamb; leveling the door; nailing the casing of the first door leg proximal the top hinge; nailing the casing of the first door leg proximal the bottom hinge; pushing the header upwardly and applying glue to the casings of the header where the casings of the header abut the casings of the first and the second legs when fully assembled; pushing the header down such that the casings of the header abut the casings of the first and the second legs; nailing a remainder of the doorframe in place; filling unused ones of the at least two recessed hinge placements on a first side of the first leg jamb and at least two recessed hinge placements on a second side of the first leg jamb; and covering an unused one of the first precut striker plate placement and striker hole and the second precut striker plate placement and striker hole.

Advantageously, a single doorframe system is used for both right-handed and left-handed opening doors. Thus, a purchaser does not need to know in advance, which doorframe system is required. The only information required is the size of the doorframe and door to be used. Further, each door matches with each doorframe of the correct size. Thus, each door is useable as a left or right-handed opening door. Also, appropriate spacing between the door and the doorframe is provided to inhibit binding of the door in the doorframe. Further, predrilled holes are provided for nailing the header casings and the leg casings in place. Also, predrilled holes are provided for nailing the doorstop components in place.

The present system also provides good alignment of the header and the legs of the doorframe. The header and first leg are assembled in the roughed in the doorway by inserting the dowels into their respective holes until the header casings meet the leg casings. Thus, the casings align and abut.

These together with other aspects and advantages, which will be subsequently apparent, reside in the details of construction and operation as more fully hereinafter described and claimed.

BRIEF DESCRIPTION OF THE DRAWINGS

The invention will be better understood with reference too the drawings, and the following description, in which.

DETAILED DESCRIPTION OF THE PREFERRED EMBODIMENTS

The present invention is an improvement over applicant's own Wood Door Jamb System as disclosed in Canadian Patent Application No. 2,381,466, filed Apr. 11, 2002.

Figure 1:
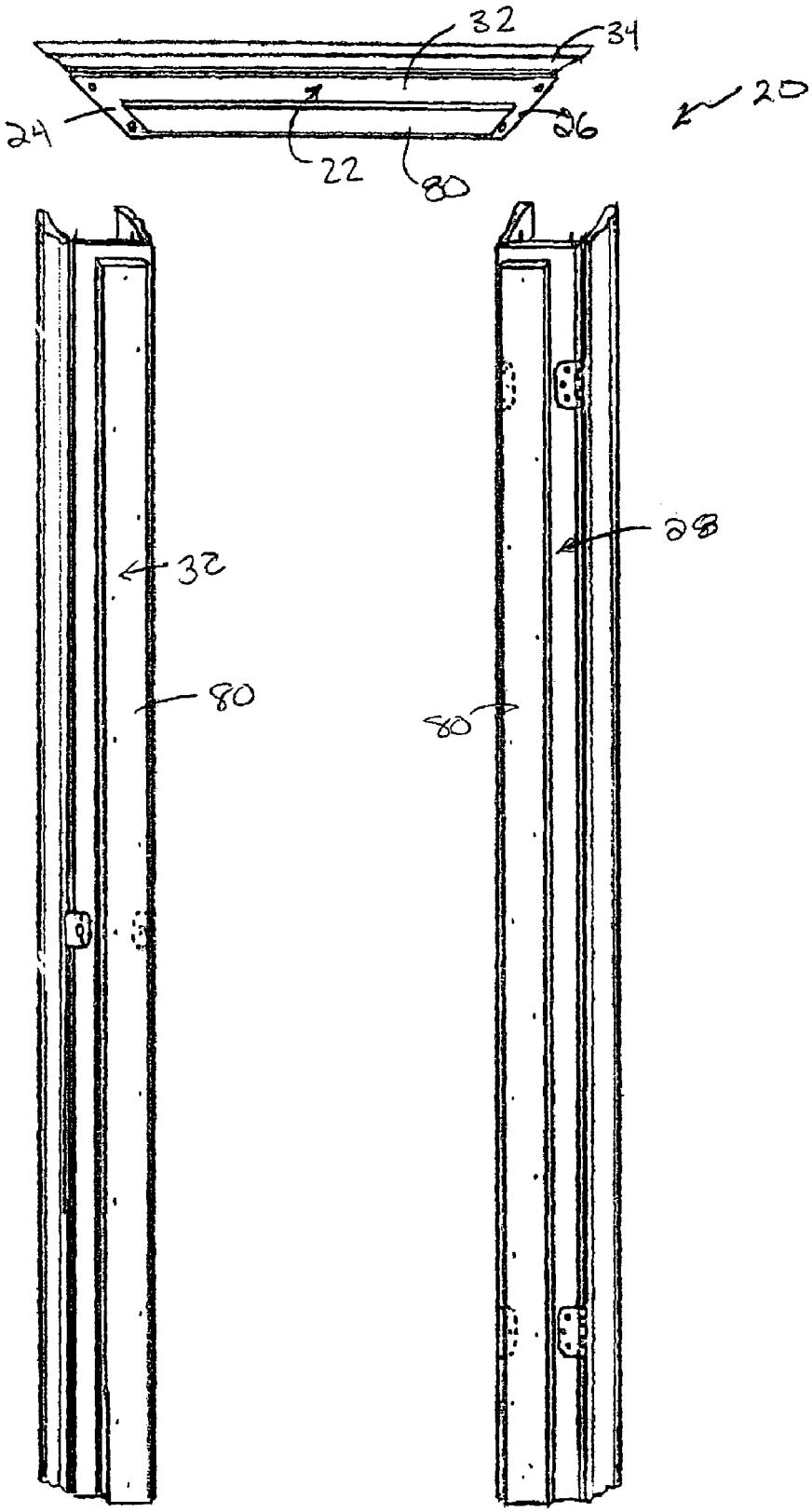
FIG. 1 is a perspective view of a doorframe according to an aspect of an embodiment of the present invention, the system shown in an unassembled state.

Reference is first made to FIG. 1 to describe a preferred embodiment of a doorframe system designated generally by the numeral 20. The doorframe system 20 includes a header 22 having first and second ends 24, 26, respectively. A first leg 28 is provided for attachment to the first end 24 of the header 22. Similarly, a second leg 30 is provided for attachment to the second end 26 of the header 22.

The header 22 includes a header jamb 32 and a pair of header casings 34, only one of which is shown in FIG. 1. Each one of the pair of header casings 34 is attached to a respective side of the header jamb 32 and extends substantially the length thereof. A suitable material for the header jamb 32 includes, for example, a medium density fiberboard and the casings 34 are attached to the sides of the header jamb 32 by suitable means such as wood staples and wood glue. Preferably the back surface of each of the header casings 34 is concave.

Figure 2:
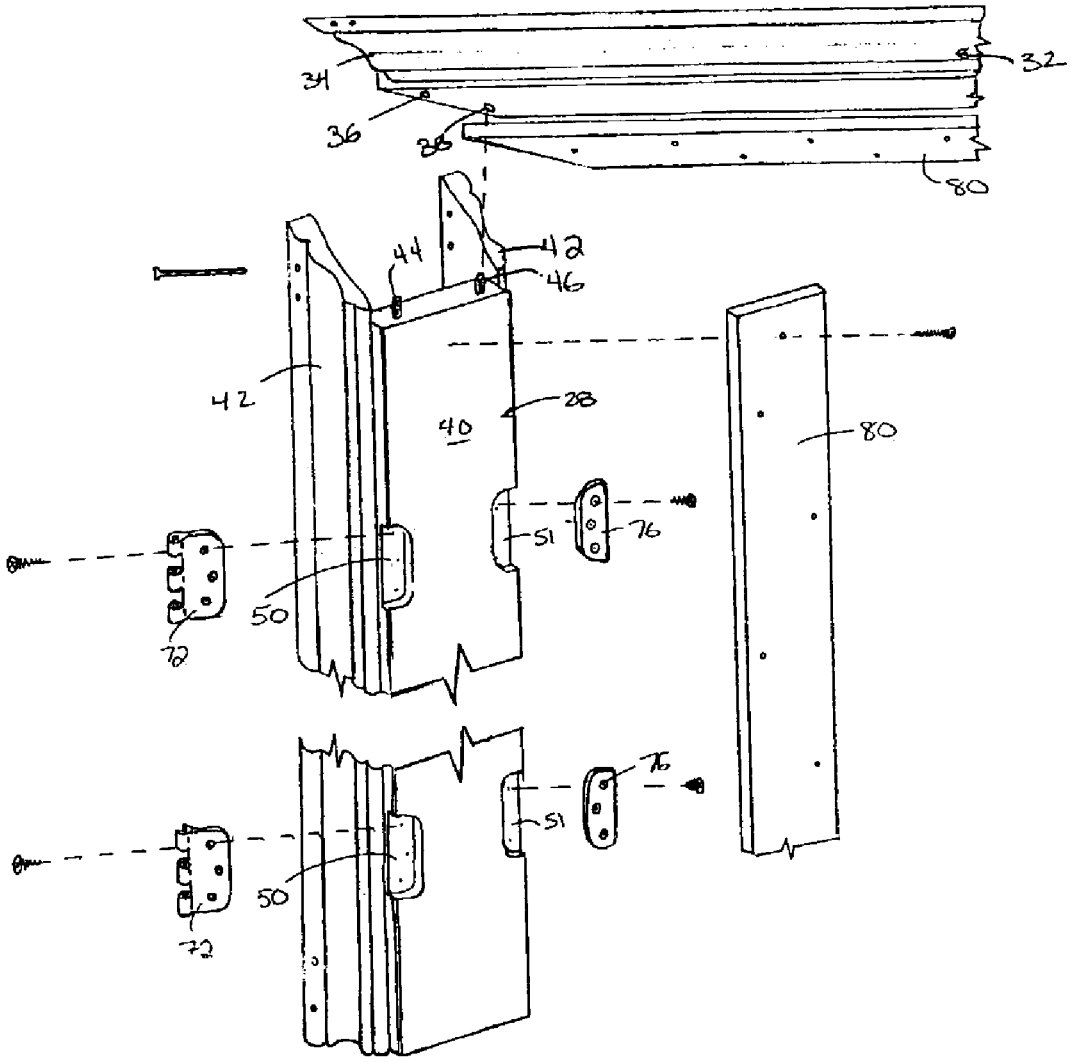
FIG. 2 is a perspective view of a portion of a doorframe according to an aspect of another embodiment.

Reference is now made to FIG. 2 to describe the first end of the header 22 in more detail. FIG. 2 includes a portion of the header 22, drawn to a larger scale. A pair of holes 36, 38 in the header jamb 32 are laterally spaced from each other and are proximal an end of the header 22, as shown. In the present embodiment these holes 36, 38 are 6.7 millimeters (0.264 inches) in diameter and extend through the thickness of the header jamb 32. The ends of the header casings 34 are cut at approximately a forty-five degree angle such that the end of an upper surface of the jamb 32 is flush with the end of the header casings 34. The purpose of the holes 36, 38 will be apparent from the following description. It will be appreciated that the second end 26 of the header 22 is the mirror image of the first end 24, with the ends of the casings 32 cut at substantially the opposite forty-five degree angle, as best shown in FIG. 1.

Referring still to FIG. 2, a portion of the first leg 28 is shown. The first leg 28 includes a leg jamb 40 and a pair of leg casings 42. Each of the pair of leg casings 42 is attached to a respective side of the leg jamb 40 and extends substantially the length thereof. The leg jamb,40 is made of similar materials as the header jamb 32. Similarly, the leg casings 42 are made of similar materials as the header casings 34. Preferably the back surface of each of the leg casings 42 is concave.

A pair of pins or dowels 44, 46 are laterally spaced from each other and extend from the end of the leg jamb 40. The dowels are secured in the end of the leg jamb 40 by friction fit in two end holes drilled in the leg jamb 40. In the present embodiment the dowels 44, 46 are 5.95 millimeters (15/64 inches) in diameter. The dowels 44, 46 extend from the center of the thickness of the leg jamb 40 to inhibit splitting caused by stresses induced by the friction fit of the dowels in the holes in the leg jamb 40. The ends of the leg casings 32 are cut at approximately a forty-five degree angle and protrude from the end of the leg jamb 40. It will be appreciated that the opposing end of the first leg 28 is adjacent the floor of a building when the doorframe of the system 20 is assembled in a roughed-in doorway of the building. Thus, the opposing end does not include wood dowels and, the leg jamb 40 and the pair of leg casings 42 are cut across a plane at approximately a ninety-degree angle (through the thickness of the leg 28 and across the width).

The second leg 30 includes a leg jamb, casings and dowels, and is a mirror image of the first leg 28. Because the second leg 30 is similar (but mirror image) to the first leg 28, the configuration need not be further explained herein.

It will now be appreciated that the holes 36, 38 of the header 22 are appropriately sized and positioned to receive the dowels 44, 45 of the first leg 28 when the doorframe system 20 is assembled. Also, the header casings 24 and the leg casings 42 are cut at complementary angles (approximately forty-five degrees, as discussed above) in order to abut each other when the header 22 and the first leg 28 is assembled. Clearly the features of the second leg 30 and the second end 26 of the header 22 are similar to the first leg 28 and the first end 24 of the header 22. Thus, the features of the second leg 30 and the second end 26 of the header are complementary for assembly of the doorframe system 22.

The first leg 28 includes a first pair of recessed hinge placements 50 on a first side of the leg jamb 40 for attachment of hinges upon assembly with a door. These hinge placements are precut, preferably by router, at a first side in the jamb 40 of the leg 28. The first pair of recessed hinge placements 50 are located at the appropriate positions, as would be understood by those of skill in the art, for attachment of a door in the doorframe.

The first leg 28 also includes a second pair of recessed hinge placements 51 on a second side of the leg jamb 40 for the attachment of hinges upon assembly with a door. Similar to the first pair of recessed hinge placements 50, the second pair of recessed hinge placements 51 are precut, preferably by router, at a second side in the leg jamb 40 of the first leg 28. The second pair of recessed hinge placements 51 are located at the appropriate positions for receiving hinges for attachment of a door in the doorframe. Each of the first and the second pair of recessed hinge placements 50, 51, respectively, are precut to a depth of about one millimeter (1 mm) less than the thickness of the side of the hinges for fixing in one of the pairs of hinge placements 50, 51.

Figure 3:
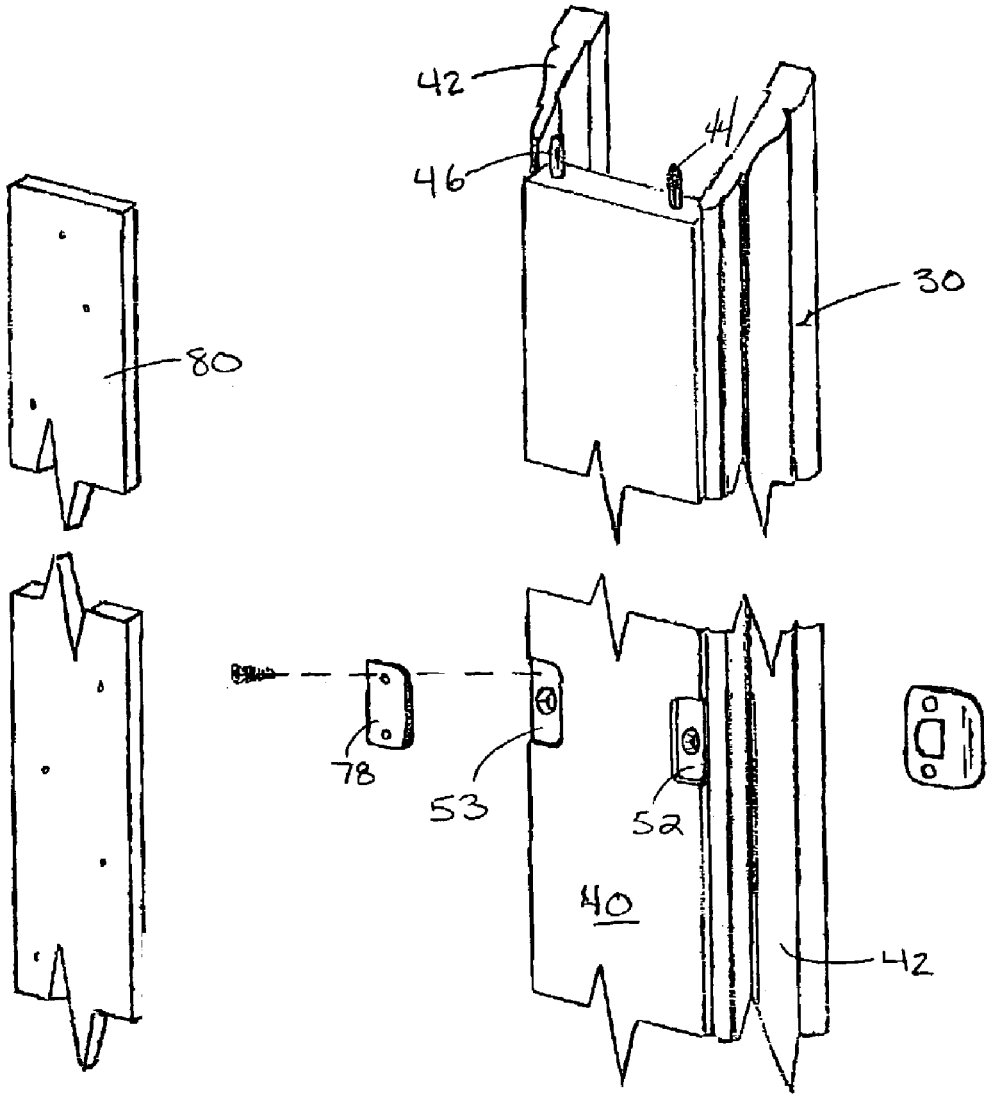
FIG. 3 is a perspective view of a second leg of the doorframe of FIG. 2.

Referring now to FIG. 3, the second leg 30 includes a first precut striker plate placement and striker hole 52 on a first side of the leg jamb 40. The first precut striker plate placement and striker hole 52 are appropriately sized and positioned in the leg jamb 40 for attachment of the striker plate and for receiving a striker of a door. The second leg 30 also includes a second precut striker plate placement and striker hole 53 on a second side of the leg jamb 40. The second precut striker plate and striker hole 53 are appropriately sized and positioned in the leg jamb 40 for attachment of the striker plate and for receiving a striker of a door.

Figure 4:
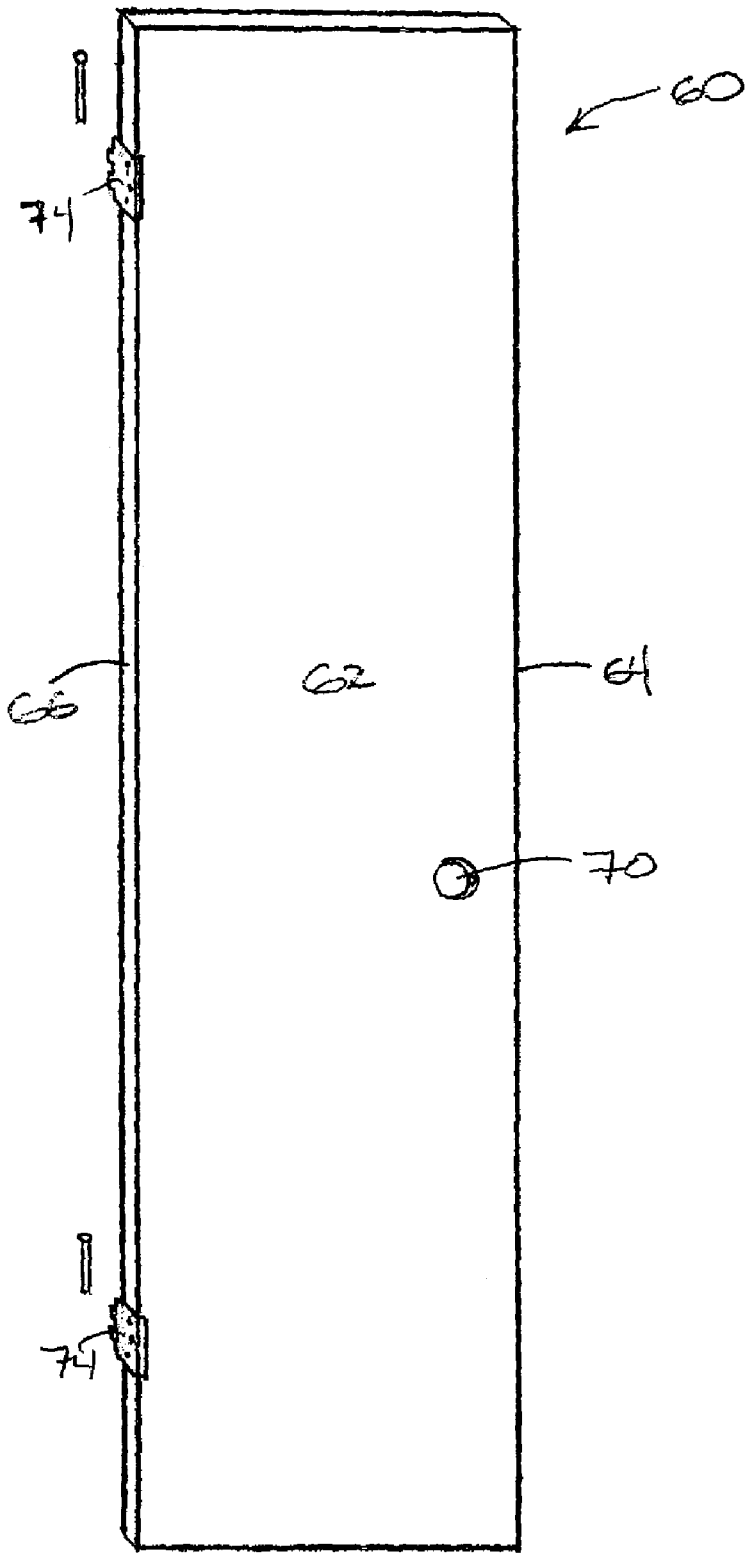
FIG. 4 is a perspective view of a door according to an aspect of another embodiment of the present invention, the door for attachment in the doorframe of FIG. 1.
Figure 5:
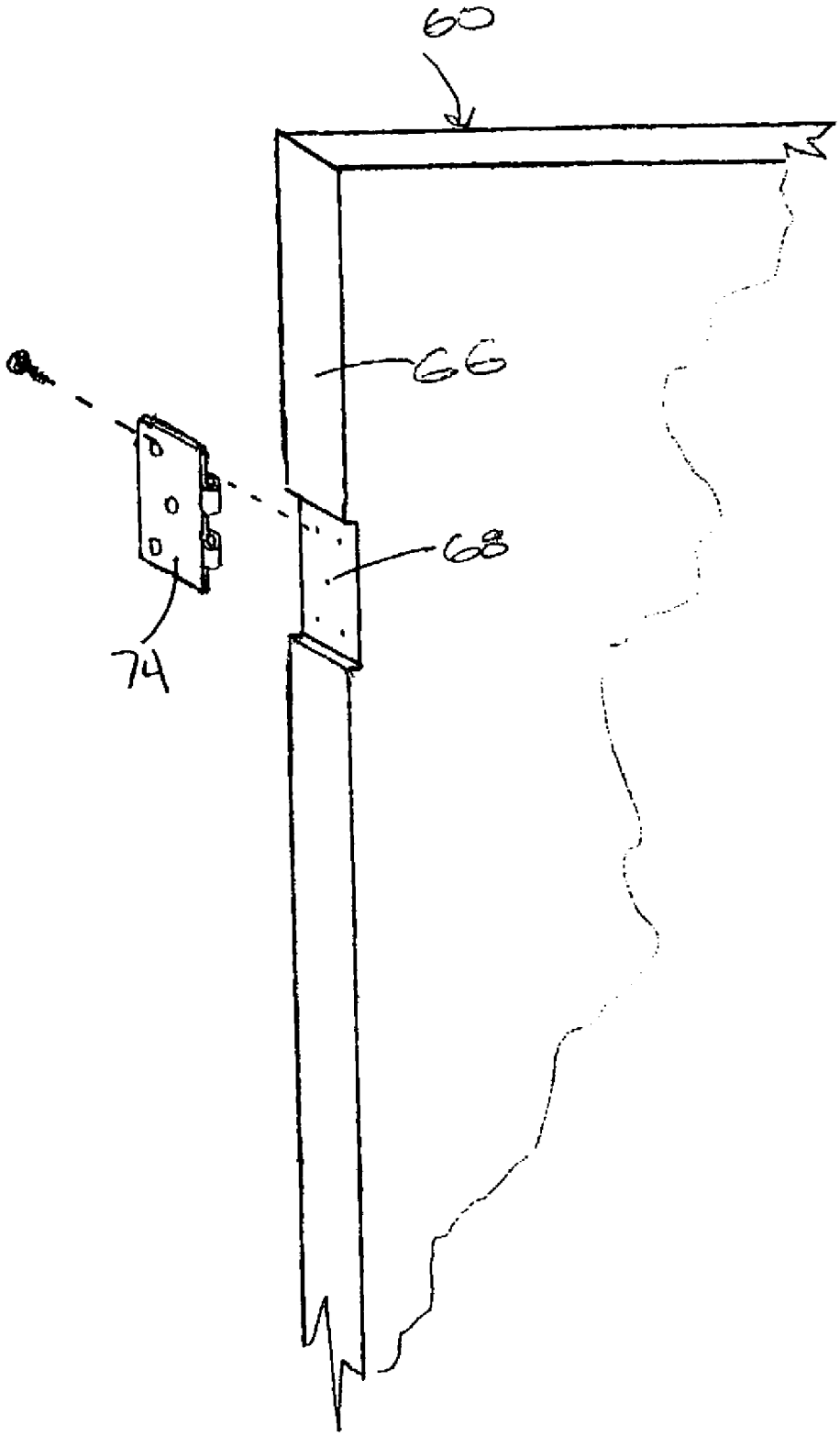
FIG. 5 shows a portion of a door according to an aspect of another embodiment of the present invention, the door for attachment in the doorframe of FIG. 2.

Reference is now made to FIGS. 4 and 5 to describe a door intended for use with the above-described doorframe 20 and indicated generally by the numeral 60. The door 60 includes a pair of sides 62, a front edge 64 and a rear edge 66. The rear edge 66 includes a pair of recessed hinge placements 68 that extend the width of the rear edge 68. The recessed hinge placements 68 are preferably cut to a depth of about one millimeter (1 mm) less than the thickness of the hinge side intended to be fixed therein.

The front edge 64 is substantially normal (at a ninety degree angle) to each of the sides 62. Similarly, the rear edge 66 is substantially normal to each of the sides 62.

The door 60 also includes a handle and striker hole 70 suitably sized and located in an appropriate position proximal the front edge 64 for receiving the handle and associated hardware including the striker.

With reference to the above description and the Figures, the assembly and use of the doorframe system 20 and door 60 will now be described. The header 22 and first leg 28 are assembled in the roughed in doorway by inserting the dowels 44, 46 into their respective holes 36, 38 until the forty-five degree angle cuts in the header casings 34 meet the 45 degree angle cuts in the leg casings 42. The forty-five degree angle cuts align and abut, however, the lower surface of the header jamb 32 does not abut the end surface of the leg jamb 40. In the above-described embodiment, the difference in diameter between the wood dowels 44, 46 and the holes 36, 38 is less than 0.80 millimeters (1/32 inch). Thus, there is good alignment of the leg 28 and the header 34 and of the forty-five degree angle cut casings. The second leg 30 is connected with the header 22 in a similar manner. It will be understood that the first leg 28 is assembled on the side of the roughed-in doorframe from which it is desired that the door 60 hinges or rotates about.

First hinge sides 72 are attached to the first leg 28 in one of the pairs of recessed hinge placements 50, 51. It will be understood that the pair of recessed hinge placements 50, 51 in which the first hinge sides 72 are placed, is chosen depending on the direction in which it is desired that the door will open (inwardly or outwardly). In the embodiment of FIG. 2, the first hinge sides 72 are fixed by screw attachment in the first pair of recessed hinge placements 50. The first hinge sides 72 protrude from the first pair of recessed hinge placements 50 by about 1 mm in the thickness direction of the first hinge sides 72. In other words, the recessed hinge placements 50, 51 are not deep enough to receive the entire thickness of the first hinge sides 72.

Second hinge sides 74 are attached to the door 60 in the recessed hinge placements 68 that extend through the thickness of the door 60. Preferably the second hinge sides are attached to the door 60 using wood screws. As will be understood, the second hinge sides 74 are attached to the door 60 in the appropriate direction for operable engagement with the first hinge sides 72. Preferably, the second hinge sides 74 are rectangular in shape to cover the entire recessed hinge placements 68. The second hinge sides 74 protrude from the recessed hinge placements 68 in the rear edge 66 of the door. In other words, the recessed hinge placements 68 are not deep enough to receive the entire thickness of the second hinge sides 74.

Next, the door 60 is hung on the doorframe, by inserting hinge pins to hold the first hinge sides 72 in cooperation with the second hinge sides 74, as will occur to those of skill in the art. A shim is then placed under the leg jamb 40 and the door is leveled. Next, the leg casings 42 of the first leg 28 are nailed into place by nailing the casing 42 beside the top hinge followed by nailing the casing beside the bottom hinge.

As described herein above, the first hinge sides 72 and second hinge sides 74 protrude from their respective placements by about one millimeter. It will now be understood that the door and header 32 are appropriately sized to provide space for the additional one millimeter for each side 72, 74 of the hinges, thereby providing additional space between the door and the doorframe to inhibit binding of the door in the doorframe.

The header is then pushed upwardly to apply glue at the forty-five degree angle cuts in the casings, between the header casings 34 and the leg casings 42. Next, the header is pulled back into place such that the forty-five degree angle cuts of the casing abut and then the casings are nailed proximal the forty-five degree angle cuts to keep the casings together. The remainder of the doorframe is then secured into place by nailing the second leg into place. In the present embodiment, the header casings 34 and leg casings 42 include predrilled holes through which the header casings 34 and leg casings 42 are nailed to the roughed-in doorframe.

Suitably shaped fillers 76 such as fiberboard cutouts, are provided for filling the unused recessed hinge placements. In the present embodiment, the unused recessed hinge placements are the second pair of recessed hinge placements 51. The fillers 76 are fixed in place using any suitable means such as wood screws or glue. Similarly, a suitably shaped cover 78 is provided for covering the precut striker plate placement and striker hole that is not used. In the present embodiment; the unused precut striker plate placement and striker hole is the second precut striker plate placement and striker hole 53. The cover 78 is fixed in place using any suitable means such as wood screws or glue.

The system 20 also includes doorstop components 80 for addition to the header jamb 32 and leg jambs 40 after installation of the remainder of the doorframe in the roughed-in doorway. The doorstop components 80 are shown unattached in FIG. 2 and attached in FIG. 1. In the present embodiment, the doorstop components 80 are wide to cover a large portion of the fillers 76 and cover 78. The doorstop components 80 also include predrilled holes through which the doorstop components 80 are nailed to their respective header jamb 32 and leg jambs 40.

It will occur to those skilled in the art that the door 60 can alternatively be attached by hinges to the second pair of recessed hinge placements 51. The door hinges are attached to the door accordingly. Thus, the filler material 76 is fixed in the unused first pair of recessed hinge placements 50 and the cover 78 is placed in the unused striker plate recess and striker hole 52. Clearly, the unused striker plate recess and striker hole is determined by which pair of recessed hinge placements are used.

The many features and advantages of the invention are apparent from the detailed description and, thus, it is intended by the appended claims to cover all such features and advantages of the invention that fall within the true spirit and scope of the invention. Several modifications and changes may occur to those skilled in the art. For example, the size and shape of many of the features can vary while still performing the same function. Alternative materials and alternative joining methods and materials can be used. Also, there can be more than two holes at each end of the header and thus, there can be more, than 2 complementary dowels at the end of each leg. Several different sizes of doorframes and corresponding doors can be provided. More than two recessed hinge placements can be provided on each side of the door jamb and thus, more than two corresponding recessed hinge placements can be provided at the rear edge of the door. For example, a door may be hung using three hinges rather than two. Also, the size and shape of the doorstop components can vary and can cover all of the fillers and the cover. The doorframes, doors and hardware can be packaged together for sale or can be sold individually. Others variations and modifications will occur to those of skill in the art. All such modifications and variations are considered to be within the scope and sphere of the invention.

What is claimed is:

1. A doorframe system comprising:

a header having a header jamb and a pair of header casings, the header having first and second ends;

a first leg having a first leg jamb and a pair of first leg casings, said first leg jamb having means for connection with said first end of said header, at least two recessed hinge placements on a first side of said first leg jamb and at least two recessed hinge placements on a second side of said first leg jamb, each of said recessed hinge placements suitable for receiving a first side of a hinge; and a second leg having a-second leg jamb and a pair of second leg casings, said second leg jamb having means for connection with said second end of said header, a first precut striker plate placement and striker hole on a first side of said second leg jamb for receiving a striker of a door when said doorframe is assembled and a door is attached to said at least two recessed hinge placements on said first side of said first leg jamb, and a second precut striker plate placement and striker hole on a second side of said second leg jamb for receiving a striker of a door when said doorframe is assembled and said door is attached to said at least two recessed hinge placements on said second side of said first leg jamb.

2. The doorframe system according to claim 1, further comprising a door for attachment to either of said at least two recessed hinge placements on said first side of said first leg jamb and said at least two recessed hinge placements on said second side of said first leg jamb, said door having first and second sides, front and rear edges and at least two recessed hinge placements in said rear edge extending the width thereof.

3. The doorframe system according to claim 2 wherein said front and said rear edges of said door are substantially normal to the first and second sides of said door.

4. The doorframe system according to claim 2, further comprising at least two hinges, each hinge including a first side for attachment to one of said at least two recessed hinge placements on said first side of said first leg jamb and said at least two recessed hinge placements on said second side of said first leg jamb, and a second side for attachment to said door at a corresponding one of said at least two recessed hinge placements of said door.

5. The doorframe system according to claim 4 wherein said first side of each of said at least two hinges is thicker than the recesses of each of said recessed hinge placements, such that said first side of each of said at least two hinges protrudes from said door jamb.

6. The doorframe system according to claim 5 wherein said first side of each of said at least two hinges-protrudes from said door jamb by about 1 millimeter.

7. The doorframe system according to claim 4 wherein said second side of each of said at least two hinges is thicker than the recesses of each of said recessed hinge placements of said door, such that said second side of each of said at least two hinges protrudes from said rear edge of said door.

8. The doorframe system according to claim 6 wherein said second side of each of said at least two hinges protrudes from said rear edge of said door by about 1 millimeter.

9. The doorframe system according to claim 1, further comprising a filler material for filling in unused ones of said at least two recessed hinge placements on said first side of said first leg jamb and said at least two recessed hinge placements on said second side of said first leg jamb.

10. The doorframe system according to claim 9, further comprising a cover material for covering an unused one of said first precut striker plate placement and striker hole and said second precut striker plate placement and striker hole.

11. The doorframe system according to claim 10, further comprising doorstop components for attachment to each of said header, said first leg jamb and said second leg jamb, said doorstop components being wide for covering at least a portion of said cover material and at least a portion of each of said filler materials.

12. The doorframe system according to claim 4, wherein said second side of said at least two hinges is substantially rectangular to cover said recessed hinge placements in the rear edge of said door.

13. The doorframe system according to claim 1, wherein said header has a pair of laterally spaced holes proximal each of said first and second ends, said first door leg has a pair of dowels extending from an end thereof, said dowels for being received in said pair of holes proximal said first end of said header when said system is assembled, and said second door leg has a pair of dowels extending from an end thereof, said dowels for being received in said pair of holes proximal said second end of said header when said system is assembled.

14. The doorframe system according to claim 13 wherein said first door leg casings abut said header casings and said second door leg casings abut said header casings when said system is assembled, said header jamb being out of contact with said first door leg jamb and said second door leg jamb.

15. The doorframe system according to claim 14 wherein said first door leg casings abut said header casings at an approximately forty-five degree angle cut in each of said casings, and said second door leg casings abut said header casings at an approximately forty-five degree angle cut in each of said casings.

16. A door and doorframe system comprising:

a door having first and second sides and front and rear edges, said door further having at least two recessed hinge placements in said rear edge and extending the width thereof, each of said at least two recessed hinge placements for receiving a second side of a hinge;

a header having a header jamb and a pair of header casings, the header having first and second ends and a pair of laterally spaced holes proximal each of said first and second ends;

a first leg having a first leg jamb and a pair of first leg casings, said first leg jamb having a pair of dowels extending from an end thereof, said dowels for being received in said pair of holes proximal said first end of said header when said system is assembled, said first leg jamb further having at least two recessed hinge placements on a first side of said first leg jamb and at least two recessed hinge placements on a second side of said first leg jamb, each of said recessed hinge placements suitable for receiving a first side of a hinge; and a second leg having a second leg jamb and a pair of second leg casings, said jamb of said second leg having a pair of dowels extending from an end thereof, said dowels for being received in said pair of holes proximal said second end of said header when said system is assembled, said second leg jamb having a first precut striker plate placement and striker hole on a first side of said jamb for receiving a striker of the door when said doorframe is assembled and said door is attached to said at least two recessed hinge placements on said first side of said first leg jamb, and a second precut striker plate placement and striker hole on a second side of said second leg jamb for receiving a striker of said door when said doorframe is assembled and said door is attached to said at least two recessed hinge placements on said second side of said first leg jamb, whereby said door is attachable by hinges to either of said at least two recessed hinge placements on said first side of said first leg jamb and said at least two recessed hinge placements on said second side of said first leg jamb.

17. A method of installing a doorframe system into a dry-walled, roughed-in opening, the doorframe system comprising a header having a header jamb and a pair of header casings, the header having first and second ends, a first leg having a first leg jamb and a pair of first leg casings, said first leg jamb having means for connection with said first end of said header, at least two recessed hinge placements on a first side of said first leg jamb and at least two recessed hinge placements on a second side of said first leg jamb, each of said recessed hinge placements suitable for receiving a first side of a hinge, a second leg having a second leg jamb and a pair of second leg casings, said jamb of said second leg having means for connection with said second end of said header, said second leg jamb having a first precut striker plate placement and striker hole on a first side of said jamb for receiving a striker of a door when said doorframe is assembled and a door is attached to said at least two recessed hinge placements on said first side of said first leg jamb, and a second precut striker plate placement and striker hole on a second side of said second leg jamb for receiving a striker of a door when said doorframe is assembled and a door is attached to said at least two recessed hinge placements on said second side of said first leg jamb, the method comprising:

placing the header and first leg in the roughed-in doorway and inserting the dowels of said first door leg into the holes of said first end of said header;

placing the second leg in the roughed-in doorway and inserting the dowels of the second door leg into the holes of said second end of said header;

hanging a door using hinges on one of said at least two recessed hinge placements on a first side of said first leg jamb and at least two recessed hinge placements on a second side of said first leg jamb;

leveling said door;

nailing said casing of said first door leg proximal said top hinge, nailing said casing of said first door leg proximal said bottom hinge;

pushing said header upwardly and applying glue to said casings of said header where said casings of said header abut said casings of said first and said second legs when fully assembled;

pushing said header down such that said casings of said header abut said casings of said first and said second legs;

nailing a remainder of said doorframe in place;

filling unused ones of said at least two recessed hinge placements on a first side of said first leg jamb and at least two recessed hinge placements on a second side of said first leg jamb; and covering an unused one of said first precut striker plate placement and striker hole and said second precut striker plate placement and striker hole.

18. The method according to claim 17, further comprising the step of nailing door jamb components in suitable locations along said header jamb, said first door leg jamb and said second door leg jamb.

* * * * *